US007150690B1

(12) United States Patent
Cusick

(10) Patent No.: US 7,150,690 B1
(45) Date of Patent: Dec. 19, 2006

(54) SOCCER GOAL PADDING

(75) Inventor: Nicholas J. Cusick, Lincoln, NE (US)

(73) Assignee: Bison, Inc., Lincoln, NE (US)

( * ) Notice: Subject to any disclaimer, the term of this patent is extended or adjusted under 35 U.S.C. 154(b) by 74 days.

(21) Appl. No.: 10/710,625

(22) Filed: Jul. 26, 2004

(51) Int. Cl.
*A63B 63/00* (2006.01)
*B61G 11/12* (2006.01)

(52) U.S. Cl. ..... 473/478; 473/492; 267/116

(58) Field of Classification Search ..... 473/478, 473/484, 481, 447, 492; 273/400; 267/140, 267/116; 206/586
See application file for complete search history.

(56) References Cited

U.S. PATENT DOCUMENTS

| | | | | |
|---|---|---|---|---|
| 5,006,386 | A * | 4/1991 | Menichini | 428/58 |
| 5,048,844 | A * | 9/1991 | Haseltine | 273/400 |
| 5,074,407 | A * | 12/1991 | Brumby | 198/841 |
| 5,273,292 | A * | 12/1993 | Pardi et al. | 273/400 |
| 5,351,948 | A * | 10/1994 | Thomas | 473/417 |
| 5,360,048 | A * | 11/1994 | Lauer | 156/86 |
| 5,839,733 | A * | 11/1998 | Meeks et al. | 273/400 |
| 5,857,928 | A * | 1/1999 | Stewart | 473/446 |
| 6,991,568 | B1 * | 1/2006 | Tien | 473/484 |

OTHER PUBLICATIONS

NPL, Safefoam, 2002, 2002 Tomark Sports Catalog, 2 pages.*
NPL web page download, Porter, 2000, www.porter-ath.com, 6 pages.*
Excerpt from Bison's Volleyball Equipment Competition Recreational Outdoor catalog; front and back cover sheets and pp. 2, 3, 5-8, 10, and 11 (Published prior to Jul. 26, 2003).
Excerpt from Bison's Premium Residential Basketball Equipment 1997-1998 catalog; front and back cover sheets and p. 12 (Published prior to Jul. 26, 2003).
Excerpt from Bison's Institutional Equipment Basketball and Volleyball 1997-1998 catalog; front and back cover sheets and pp. 2, 9, 10, 15, 16, 18-20, 26-28, 54-56, and 60 (Published prior to Jul. 26, 2003).
Excerpt from Bison's Premium Residential Basketball and Volleyball Equipment 2000-2001 catalog; front and back cover sheets and pp. 17, 20, and 21 (Published prior to Jul. 26, 2003).
Excerpt from Bison's Institutional Basketball & Volleyball Equipment 2000-2001 catalog; front and back cover sheets and pp. 11, 12, 38, 42, 47, and 62 (Published prior to Jul. 26, 2003).
Excerpt from Bison's Team Sports and Park & Rec Equipment 2001-2002 catalog; front and back cover sheets and pp. 10, 11, 40, 49, 64, 72, and 73 (Published prior to Jul. 26, 2003).
Excerpt from Bison's Team Sports and Park & Rec Equipment 2002-2003 catalog; front and back cover sheets and pp. 2, 10, 11, 42, 64, and 74-75 (Published prior to Jul. 26, 2003).

* cited by examiner

*Primary Examiner*—Eugene Kim
*Assistant Examiner*—M. Chambers
(74) *Attorney, Agent, or Firm*—Hovey Williams LLP

(57) ABSTRACT

A soccer goal pad comprises an integrally formed foam body for overlying the playing surface of a goal post. The pad is self retained on the post. The goal pad provides impact-cushioning along the playing surface so as to reduce the risk of injury, while minimizing its affect on the trajectory and speed of a soccer goal bouncing off of the padded post. A method of making the goal pad is disclosed.

17 Claims, 3 Drawing Sheets

SOCCER GOAL PADDING

BACKGROUND OF THE INVENTION

1. Field of the Invention

The present invention relates generally to athletic equipment used in games involving a goal. More particularly, the present invention concerns goal padding that reduces the risk of player injury caused by impact with the goal while maintaining the desired trajectory and speed for balls rebounding off the goal.

2. Discussion of Prior Art

Soccer goals are known to be a source of injury to participants (e.g., players and officials) of a soccer game. The goal is typically made of metal (e.g., steel or aluminum) and presents a playing surface that is oriented toward the participants during a game, and impact with the playing surface can cause injury.

Conventional attempts to address this problem are unsatisfactory. In particular, goal padding has been developed to provide impact cushioning along the playing surface of the goal so as to minimize the risk of injury. However, traditional goal padding tends to be bulky and unsightly. Moreover, the manner in which prior art goal padding is secured to a goal post tends to complicate the construction of the padding. For example, conventional goal padding typically utilizes a plurality of securing straps (e.g., hook and loop fastening strips) extending across a longitudinal rear slot in the padding to permit user adjustable tightening of the padding onto the post. The securing straps are traditionally fixed to a flexible case in which a foam material is contained. Yet further, conventional goal padding adversely affects the trajectory and speed of a ball rebounding off a padded post (relative to the desired ball rebound). Although reducing the risk of injury to game participants is imperative, the playing surface of the goal is considered in "play" and any influence on the desired rebound of the ball (the customary and anticipated trajectory and speed of the ball after it has bounced off of the playing surface) is highly undesirable. A ball rebounding off of a goal padded with conventional padding typically has a dramatically different trajectory and speed than that with which game participants are accustom. For example, a ball rebounding off of a conventionally padded goal post may rebound much slower and in a substantially different direction than the soccer game participants are expecting.

SUMMARY OF THE INVENTION

A first aspect of the present invention concerns a soccer goal assembly including a soccer goal and a goal pad. The goal includes a pair of spaced apart upright posts and a cross post extending between the uprights posts. Each of the posts presents a generally forward and sideward facing playing surface. The goal pad is removably wrapped at least partly around at least one of the posts to overlie the playing surface. The goal pad comprises an elongated body presenting a longitudinally extending slot defined between opposed longitudinal edges. The body is formed of a compressible and resilient material that provides impact-cushioning along the playing surface and permits resilient flexing thereof so that the edges are resiliently separable to receive the at least one post within the slot as the goal pad is installed or removed. The pad is devoid of structure extending across the slot for securing the edges relative to one another, such that the body is self-retained on the at least one post.

A similar second aspect of the present invention is a soccer goal pad for providing impact-cushioning along the generally forward and sideward facing playing surface of a soccer goal post. The goal pad comprises an elongated body including a wall that presents a generally tubular cross-sectional shape with a central opening in which the goal post is received. The wall includes longitudinally extending generally opposite front and rear portions and a pair of longitudinally extending generally opposite side portions defined between the front and rear portions. The front and side portions are dimensioned and configured to overlie the playing surface of the post. The body presents a longitudinally extending slot defined between opposed longitudinal edges, with the slot being defined in the rear portion of the wall. The body is formed of a compressible and resilient material that provides impact-cushioning along the playing surface and permits resilient flexing thereof so that the edges are resiliently separable to receive the post within the slot as the goal pad is installed or removed. The pad is devoid of structure extending across the slot for securing the edges relative to one another, such that the body is self-retaining on the goal post.

Another aspect of the present invention concerns a goal pad comprising an elongated body. The body includes a wall that presents a generally tubular cross-sectional shape with a central opening in which the goal post is received. The body presents a longitudinally extending slot defined between opposed longitudinal edges. The body is formed of a compressible and resilient material that provides impact-cushioning along the playing surface and permits resilient flexing thereof so that the edges are resiliently separable to receive the post within the slot as the goal pad is installed or removed. The body is in a resiliently flexed condition when received on the post and in a relatively unflexed condition when located off of the post. The wall presents longitudinally extending opposite wall sections that converge toward the slot when the body is in the unflexed condition and are less convergent when the body is in the flexed condition.

Yet another aspect of the present invention is directed to a goal pad comprising an elongated body. The body includes a wall that presents a generally tubular cross-sectional shape with a central opening in which the goal post is received. The body presents a longitudinally extending slot defined between opposed longitudinal edges. The body is formed of a compressible and resilient foam material that provides impact-cushioning along the playing surface and permits resilient flexing thereof so that the edges are resiliently separable to receive the post within the slot as the goal pad is installed or removed. The foam material has a Bashore Resiliency Test value of at least about 35.

In addition, an aspect of the present invention concerns a method of forming a goal pad. The method comprises the step of molding a pad preform to an initial preform shape that includes a longitudinally extending slot and a pair of wall sections on opposite sides of the slot. The method further includes the step of, after the molding step and before the final cure time, varying the preform shape so that convergence of the wall sections toward the slot is greater than in the initial preform shape. The varying step includes the step of maintaining the varied shape of the preform until the final cure time.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
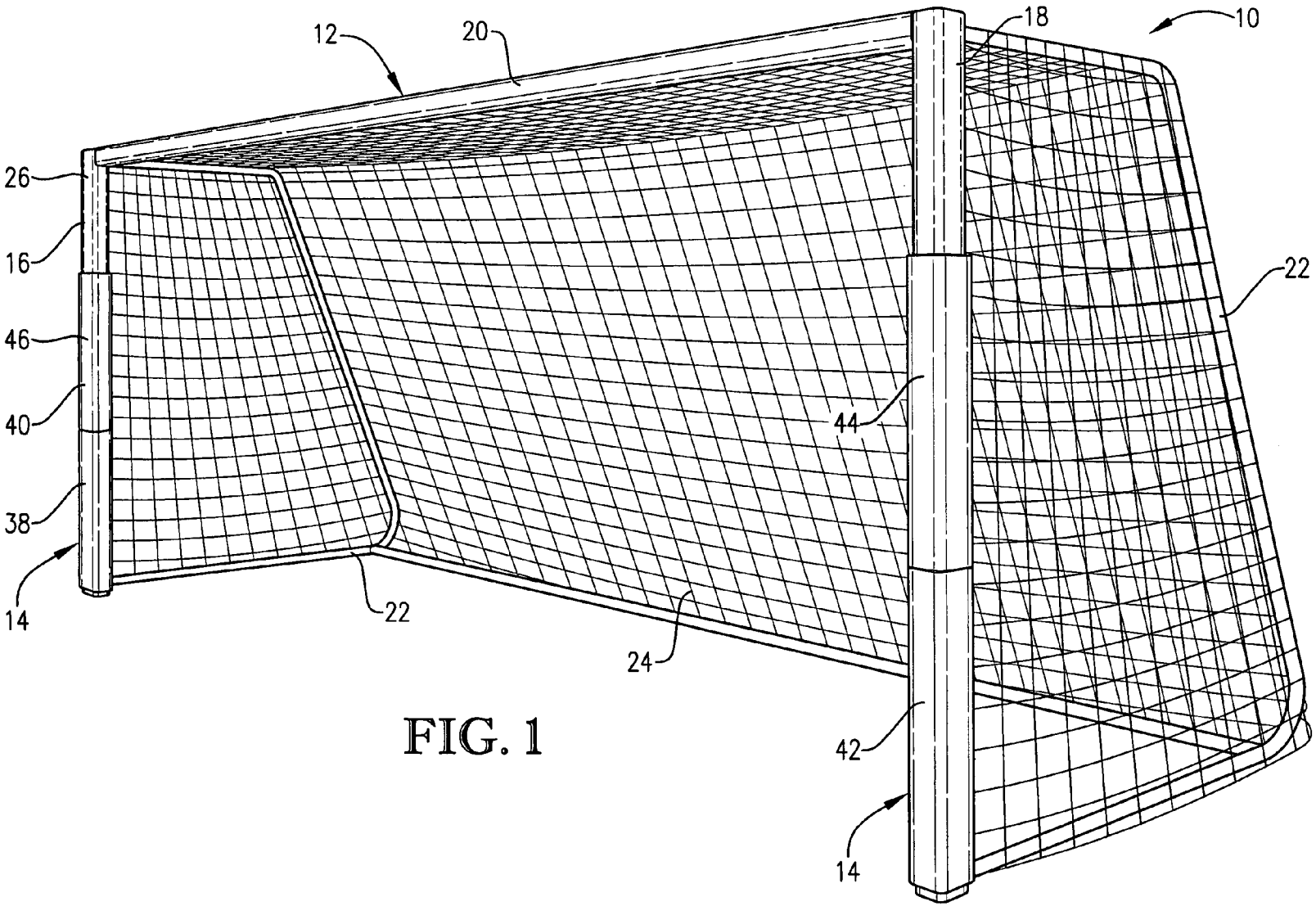
FIG. 1 is a perspective view of a soccer goal provided with padding constructed in accordance with the principles of a first embodiment of the present invention.

As shown in FIG. 1, the soccer goal assembly 10 selected for illustration includes a goal 12 and goal padding 14 constructed in accordance with the principles of the present invention. The illustrated goal 12 utilizes one of many conventional designs, and those skilled in the art will appreciate that the inventive padding 14 may be used on various other soccer goal constructions. Furthermore, the principles of the present invention may be used on other athletic equipment (e.g., the pole of a basketball goal assembly).

Therefore, it shall be sufficient to explain that the illustrated goal 12 includes a pair of spaced apart upright posts 16 and 18 (often referred to as the corner posts) that are preferably vertical in orientation. The illustrated posts 16 and 18 are fixed in the ground, although the principles of the present invention are equally applicable to a portable goal (not shown) having posts that simply rest on the ground. A cross post 20 (often referred to as a crossbar) extends between the tops of the corner posts 16 and 18. In the illustrated embodiment, the posts 16–20 are of the same shape and size; however, it is entirely within the ambit of the present invention to utilize differently shaped and sized posts. The posts 16–20 are traditionally formed of metal (e.g., tubular steel or Aluminum) and have dimensions regulated by soccer game authorities. As is customary, the goal 12 preferably includes a net-supporting framework 22 projecting rearwardly from the posts 16–20 for supporting a net 24 along the back of the goal 12. The framework 22 and net 24 are not essential elements of the present invention and may be eliminated if desired.

The posts 16–20 cooperatively define with the ground the goal area in which players attempt to shoot the soccer ball (not shown). The playing field extends from the goal 12 in the direction opposite the net 24. If the ball crosses the imaginary plane defined by the posts 16–20, a goal is scored. Those of ordinary skill in the art will appreciate that game participants are often in close proximity to the posts 16–20 and there are instances in which a participant may inadvertently impact one of the posts. Such impact with one or more of the posts 16–20 can cause injury to the participant. Furthermore, the ball has tendency to strike one or more of the posts 16–20 during play and in all known game situations the posts 16–20 are considered in "play." That is to say, as long as the ball remains in bounds, play continues when the ball impacts one or more of the posts 16–20. Consequently, ball rebounds off of the posts 16–20 are a customary and expected part of the game and, with more experienced players, the speed and trajectory of a ball rebounding off of on or more of the posts can be anticipated and even utilized as part of the playing strategy.

It will be appreciated that the forward and sideward facing surfaces of the each of the posts 16–20 are more likely to be impacted by a game participant or ball than the rearward facing surface. In this regard, these front and side surfaces have been referred to herein as the playing surface presented by each post. As perhaps best shown in FIG. 4, the posts 16–20 depicted with the first embodiment of the present invention (FIGS. 1–4) have a tubular, square-shaped cross-section. In particular, the post 16 includes an outer wall 26 having a pair of opposite side wall sections 28 and 30 and opposite front and rear wall sections 32 and 34. The wall sections 28–34 extend the full length of the post 16. A recessed, T-shaped groove 36 is provided along the center of the rear wall section 34. The post 16 preferably has a cross-sectional dimension of between about four and five inches, and most preferably has a cross-sectional dimension of four inches. As will be apparent from the description of the alternative embodiments, the principles of the present invention are not limited to the particular post construction shown in FIGS. 1–4. For example, the post 16 could alternatively present a U-shaped cross-section, with just front and side wall sections, such that the rear section is open.

In the illustrated embodiment, the padding 14 is provided on the corner posts 16 and 18 only; however, the padding 14 may alternatively be provided on the cross post 20 only or in addition to corner posts 16 and 18. The illustrated padding 14 is preferably positioned adjacent the ground and does not extend the full length of the posts 16 and 18. The padded areas of the posts 16 and 18 are believed to be the greatest sources of player injury. In this regard, the illustrated arrangement maximizes safety while minimizing the impact on ball rebounds, even though the inventive padding 14 has been determined to be particularly effective in providing relatively normal rebounding of balls off the posts. Most corner posts are approximately ninety-six inches in height (measured to the cross post 20), and the padding 14 preferably extends generally along the lowermost seventy-two inches of the posts 16 and 18. The preferred padding 14 is the same color as the posts 16 and 18 (e.g., white), although various colors or patterns may be used.

Figure 3:
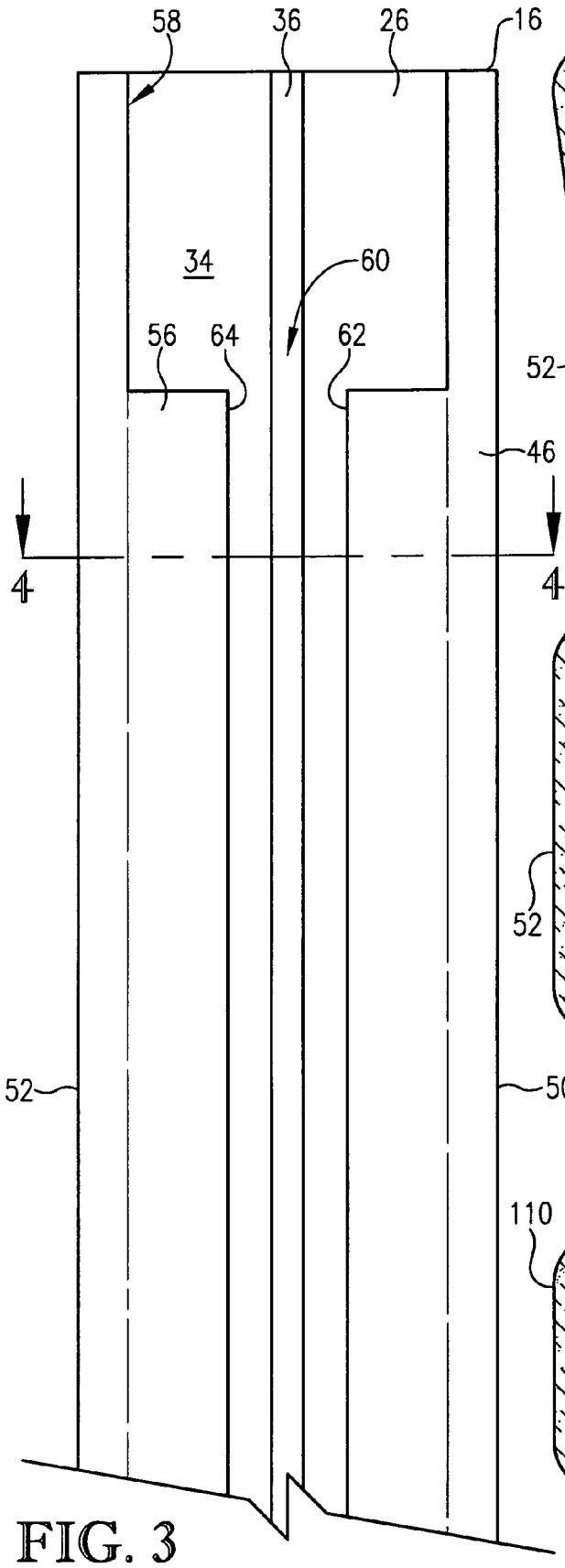
FIG. 3 is a rear elevation view of the padding on one of the upright posts of the goal as shown in FIG. 1, particularly illustrating the rear longitudinal slot of the pad.
Figure 2:
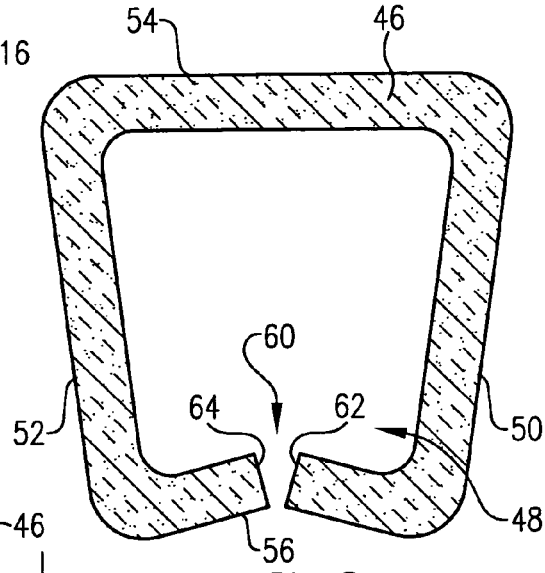
FIG. 2 is a cross-sectional view of one of the goal pads depicted in FIG. 1.
Figure 4:
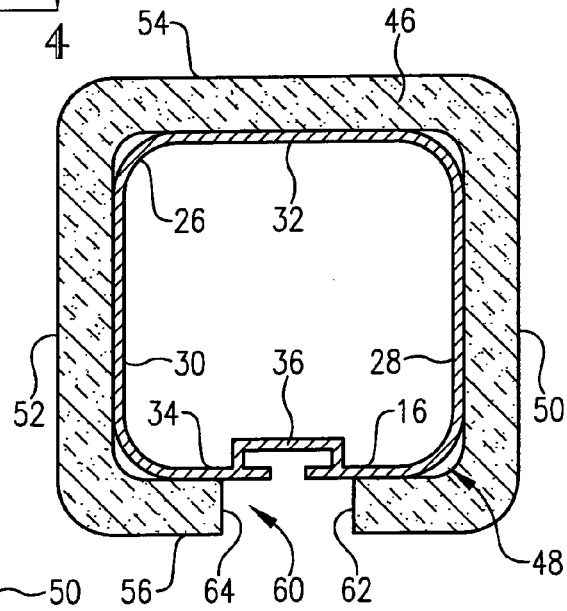
FIG. 4 is a horizontal cross-section view of the pad and post taken along line 4—4 of FIG. 3.

The padding 14 is preferably in the form of four equal length goal pads 38,40,42,44, with the illustrated pads being about thirty-six inches in length. The principles of the present invention are equally applicable, however, to various other pad configurations (e.g., pads that extend the full length of each of the posts 16–20, corner pads that span the corner junction formed by each corner post and the cross post, etc.). A suitable carrying case (not shown) may be provided for pads 38–44. The pads are preferably identical in construction. Thus, in the interest of brevity, only the upper pad 40 for the post 16 is shown in FIGS. 2–4 and will be described in detail herein, with the understanding that the other pads 38,42,44 are similarly constructed.

The pad 40 preferably has shape that conforms to the shape of the post 16. That is to say, the preferred pad 40 is square, with an internal cross-sectional dimension (e.g., four inches) that corresponds with the outer cross-sectional dimension of the post 16. In particular, the pad 40 comprises a tubular body formed of a wall 46 that presents a central opening 48 in which the post 16 is snugly received. Similar to the post 16, the pad 40 includes opposite side wall portions 50 and 52 and opposite front and rear wall portions 54 and 56. The wall portions 50–56 are preferably integrally formed in a single molding process. The front and side wall portions 50,52,54 extend the full length of the pad 40. A central recess 58 extending inwardly from each end of the pad is defined in the rear wall portion 56. Moreover, a lengthwise slot 60 extends along the center of the rear wall portion 56, with the slot being defined between opposed edges 62 and 64 of the wall 40. As perhaps best shown in FIG. 4, the pad 40 is configured so that the slot 60 is open when the pad is received on the post 16. However, the principles of the present invention are equally applicable to a pad having a slot that remains "closed" when the pad is installed (i.e., the wall edges contact one another when the pad is placed on the post). Furthermore, the slot need not be defined along the center of the rear wall portion; that is, the slot could be defined elsewhere along the rear wall portion or in one of the other wall portions altogether.

Except for the slot 60, the illustrated wall 46 is solid and continuous, although the principles of the present invention are applicable to a wall having perforations or openings (e.g., one inch circular openings spaced throughout the pad) assuming the desired structural integrity is maintained. The illustrated wall 46 has a uniform thickness. Moreover, it has been determined that the wall thickness should be less than about 50% of the maximum width dimension of the post 16 (measured from the outermost left and right points of the post 16). Again, the illustrated post 16 has a width of approximately four inches. More preferably, the wall thickness is between about 12% and about 16% of the maximum width dimension of the post. In the illustrated embodiment, the wall thickness is preferably ⅝ of one inch. The preferred wall thickness serves to provide the desired impact-cushioning along the playing surface and permit resilient flexing of the wall 46 so that the edges 62 and 64 are resiliently separable to receive the post 16 within the slot 60 as the goal pad 40 is installed or removed.

The pad 40 is preferably formed of a cellular foam material, although other flexible and compressible materials are suitable. More particularly, the pad 40 is formed of an integral skin urethane foam, although other suitable foam materials may be used. The pad preferably has a Bashore Resiliency Test value of at least about 35 (the value being determined according to ASTM D2362). Most preferably, the foam pad 40 has a Bashore Resiliency Test value of between about 40 and about 52. Such a construction is believed to provide the desired cushioning and structural characteristics, while minimizing the affect of the pad on ball rebounding. Furthermore, such a material provides the desired resiliency and rigidity for the pad 40.

The pad 40 is preferably in an unflexed condition when off of the post 16 (e.g., see FIG. 2) and is resiliently flexed when placed on the post 16 (e.g., see FIG. 4). In this regard, the configuration and resiliency of the pad 40 serve to retain the pad on the post 16, thereby eliminating the need for attachment directly to the post and means for securing the edges 62 and 64 relative to one another. In other words, the pad 40 is self-retained on the post 16. The gripping action provided by the pad 40 is primarily attributable to the construction of the wall 46. In particular, the wall 46 is configured so that the side wall portions 50 and 52 naturally converge toward the slot (i.e., converge rearwardly in the illustrated embodiment). Further, the wall portions 50 and 52 are required to resiliently flex outwardly when the post 16 is received in the central opening 48 (compare FIGS. 2 and 4). In the illustrated embodiment, the convergence between the wall portions 50 and 52 is effectively eliminated because of the orthogonal shape of the post 16; however, the principles of the present invention are equally applicable to an embodiment that simply causes the wall portions 50 and 52 to be less convergent. In any case, the tendency of the wall 46 to return to its natural unflexed condition causes the pad 40 to grip the post 16. Of course, the gripping action may also be attributed to other important features of the inventive pad 40. For example, the following features also contribute to the self-retaining quality of the pad 40: the resiliency and rigidity of the material, the integrally formed wall 46, the rear wall portion 56, the wrapping of the wall 46 about a considerable portion of the post, and the complemental shape and size of the pad 40 relative to the post 16. With particular respect to the circumferential relationships of the pad 40 and post 16, it has been determined that the wall 46 should preferably extend around at least about 75% of the perimeter of the post 16 (the perimeter may be defined by imaginary or open sections of the post in some embodiments, such as a U-shaped post).

The illustrated pad 40 is preferably constructed according to a molding process generally involving the steps of molding a pad preform (not shown) to an initial preform shape that substantially corresponds to the shape of the pad when installed on the post 16 (i.e., the side wall portions 50 and 52 are not convergent when the pad 40 is installed on the post 16). The initial preform shape is preferably otherwise similar to the final configuration of the pad 40 in its unflexed condition (i.e., the preform shape preferably includes the wall portions, the slot, etc.). Before the preform has finally cured, its shape is varied so as to create the desired convergence of the wall portions 50 and 52; that is, the ends of the wall portions 50 and 52 adjacent the slot 60 are brought closer to one another than in the initial preform shape. The wall portions 50 and 52 are maintained in the desired convergent relationship until final cure time.

Preferably, the step of molding involves injecting a sufficient quantity of two-component foam ingredient into the mold so that a skin is formed on the final product. The most preferred foam ingredient comprises two parts polyol material to one part isocyanate material (based upon volume). The mold cavity is filled approximately 25% with the foam ingredient to provide the desired pad construction. In addition, the mold temperature is preferably maintained at between about 100° and about 115° Fahrenheit.

The preform is preferably removed from the mold before the final cure time. Particularly, with the above specifications, the preform is removed from the mold approximately six minutes after the foam ingredient has been introduced into the mold cavity. The mold is then shaped to create the desired convergence of the wall portions 50 and 52 (such shaping could alternatively occur within the mold). The preform is preferably set on a surface with one of the side wall portions 50 or 52 against the surface. In other words, the preform is laid one of the wall portions 50 or 52 so that gravity causes the opposite wall section to slump in the direction of the slot. The preform is maintained in this orientation until the final cure time, which is preferably accomplished by placing the preform (with the one of the wall portions against the horizontal surface) in ambient conditions for at least approximately two hours. Final curing of the preform may alternatively be expedited using suitable techniques. Furthermore, a form may alternatively be used to facilitate shaping of the preform during final curing. It is also within the ambit of the present invention to utilize a wrap that is placed around the preform to cause the desired shaping.

Use of the pad 40 is apparent from the foregoing description. Thus, is shall be sufficient to explain that the pad 40 is resiliently stretched to pull the edges 62 and 64 away from one another so that the post 16 is received therebetween. This may be accomplished, for example, by pulling the opposite parts of the rear wall portion 56 away from one another. The pad 40 is oriented so that the post 16 is received within the opening 48, and the wall 46 is then permitted to spring into gripping contact with the post 16. If necessary, the pad 40 may be slid along the post 16 to the desired vertical position (such sliding might require the user to slightly stretch the pad). The pad 40 is thereby retained without requiring any attachment or securement means. To remove the pad 40, the process is simply reversed.

Figure 5:
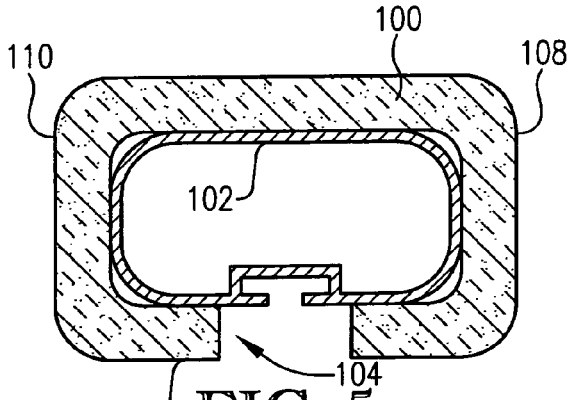
FIG. 5 is a horizontal cross-section view of an alternative goal pad constructed in accordance with the principles of a second embodiment of the present invention, particularly illustrating the rectangular-shaped pad on a similarly shaped post.

The principles of the present invention are also applicable to other pad designs and post configurations. For example, a second embodiment of the present invention is shown in FIG. 5. In particular, the second embodiment concerns a goal pad 100 having a rectangular cross-sectional shape that conforms closely to the rectangular goal post 102. The illustrated post 102 has a width of about four inches and a depth of about two inches. The slot 104 defined in the rear wall portion 106 of the pad 100 has the same open dimension as the slot 60 of the first embodiment (when installed on the post). In the second embodiment, the side wall portions 108 and 110 do not converge rearwardly toward the slot 104 when the pad is located off of the post 102. That is to say, the pad 100 is preferably not configured to resiliently flex to the same extent as the padding of the first embodiment. The method of forming the pad 100 preferably involves removing the preform from the mold and placing it on the rear wall portion 106 until the final cure time. Of course, rearward convergence of the side wall portions 108 and 110 may alternatively be provided if desired.

Figure 6:
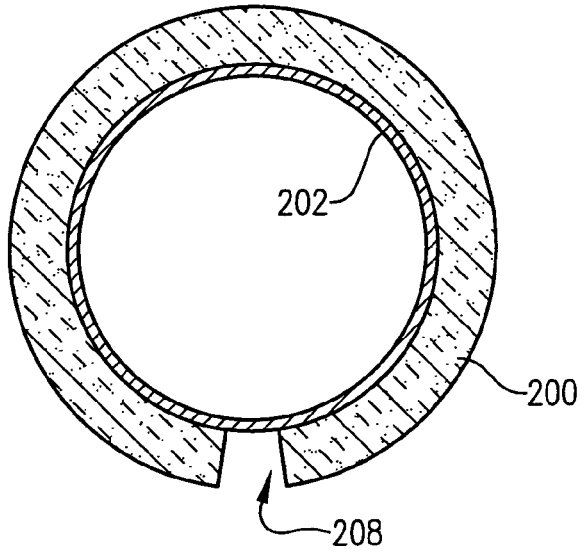
FIG. 6 is a horizontal cross-sectional view of an alternative goal pad constructed in accordance with the principles of a third embodiment of the present invention, particularly illustrating the circular-shaped pad on a circular-shaped post.
Figure 7:
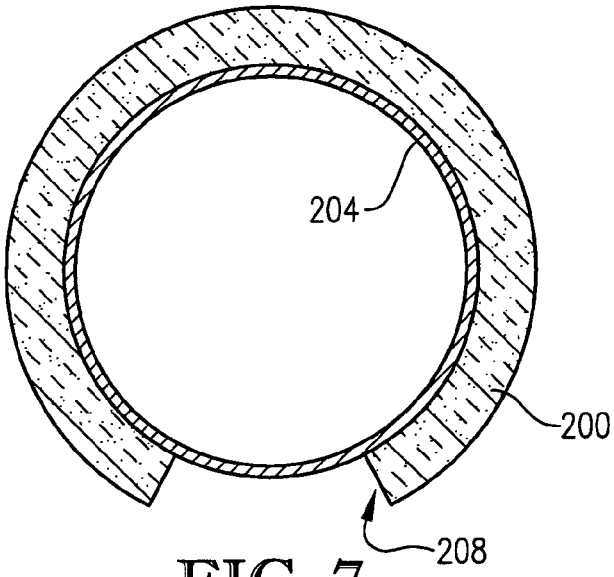
FIG. 7 is a horizontal cross-section view of the circular-shaped goal pad depicted in FIG. 6, but illustrating the pad on a relatively larger circular post than that illustrated in FIG. 6.
Figure 8:
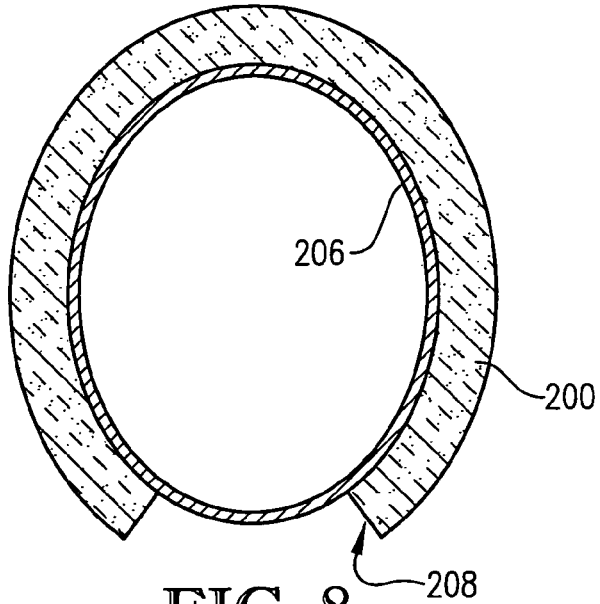
FIG. 8 is a horizontal cross-section view of the circular-shaped goal pad depicted in FIG. 6, but illustrating the pad on an elliptically-shaped post.

A third embodiment of the present invention is depicted in FIGS. 6–8. The third embodiment comprises a circular shaped pad 200. The pad 200 is depicted on a circular post 202 (FIG. 6), a relatively larger circular post 204 (FIG. 7), and an elliptical post 206 (FIG. 8). The post 202 has a diameter of approximately four inches, the post 204 has a diameter of approximately four and one-half inches, and the post 206 has a width of about four inches and a depth of about five inches. The pad 200 preferably has an internal diameter of about four inches and a wall thickness of about ⅝ of an inch. With respect to the circular posts 202 and 204, the playing surface (i.e., the front and side wall sections) is defined by the forwardmost 270° arc of the respective pad wall. The wall portions of the pad are similarly defined, although their locations relative to the underlying post vary depending upon the size of the post. The playing surface of the elliptical post 206 is defined by the portion of the wall that corresponds with the forwardmost 270° central angle measured from the elliptical center. Similar to the first embodiment, the opposite side wall portions of the pad 200 (corresponding to the opposite arcs defined between the forwardmost and rearwardmost 90° arcuate wall portions of the pad 200) are rearwardly convergent so that the pad is resiliently flexed when placed on the post. The pad 200 is formed using the technique described herein, with the preform being laid on one of the side wall portions during the final cure period.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

The invention claimed is:

1. A soccer goal assembly comprising:

a soccer goal including a post having a generally orthogonal cross-sectional post shape to present a front section and generally perpendicular side sections, with the front and side sections cooperatively defining a longitudinally extending, generally forward and sideward facing playing surface; and a goal pad removably wrapped at least partly around the post to overlie the playing surface, said goal pad including an elongated body comprising a wall that presents a generally tubular cross-sectional pad shape with a central opening in which the goal post is received, said wall presenting an inner surface that defines the central opening, said wall including at least three longitudinally extending, generally straight wall portions, with a pair of the wall portions being spaced apart and projecting from a first one of the wall portions, said body presenting a longitudinally extending slot defined between opposed longitudinal edges, said body being formed of a compressible and resilient material that provides impact-cushioning along the playing surface and permits resilient flexing thereof so that the edges are resiliently separable to receive the post within the slot as the goal pad is installed or removed, said body being in a resiliently flexed condition when received on the post and in a relatively unflexed condition when located off of the post, said pair of wall portions converging toward the slot when the body is in the unflexed condition and being less convergent when the body is in the flexed conditions said wall portions assuming a generally orthogonal shape and the inner surface contacting and closely conforming to the post shape when the body is received on the post.

2. The soccer goal assembly as claimed in claim 1, said post presenting a rear section opposite the front section, with the side sections extending therebetween, said slot being positioned along the rear section of the post, said pair of the wall portions converging rearwardly toward the slot.

3. The soccer goal assembly as claimed in claim 2, said first one of the wall portions overlying the front section of the post, and said pair of wall portions each overlying a respective one of the side sections of the post, said wall including a rear wall portion opposite the first one of the wall portions, with the pair of wall portions extending therebetween, said wall having a orthogonal cross-sectional shape, with the first and rear portions being generally parallel to one another and the pair of wall portions being generally parallel to one another, when the body is received on the post.

4. The soccer goal assembly as claimed in claim 1, said wall having a maximum thickness of about ⅝ of an inch.

5. The soccer goal assembly as claimed in claim 1, said body being formed of a foam material, said foam material having a Bashore Resiliency Test value of at least about 35.

6. The soccer goal assembly as claimed in claim 1, said edges being spaced apart when the body is in the flexed condition, such that the slot is open when the body is in the flexed condition.

7. The soccer goal assembly as claimed in claim 1, said opposite portions being generally parallel when the body is in the flexed condition.

8. The soccer goal assembly as claimed in claim 5, said wall having a maximum thickness of about ⅝ of an inch.

9. The soccer goal assembly as claimed in claim 5, said foam material having a Bashore Resiliency Test value of between about 40 and about 52.

10. The soccer goal assembly as claimed in claim 9, said foam material comprising an integral skin urethane foam.

11. The soccer goal assembly as claimed in claim 1, said goal including a pair of spaced apart upright posts and a cross post extending between the uprights posts, with the first-mentioned post being one of the upright or cross posts, said posts being similarly shaped and dimensioned.

12. The soccer goal assembly as claimed in claim 11; and at least one additional goal pad on one of the other posts, said at least one additional goal pad being similar in construction and function to the first-mentioned goal pad.

13. The soccer goal assembly as claimed in claim 12, each of said goal pads being received on a respective one of the upright posts.

14. The soccer goal assembly as claimed in claim 1, said post presenting a maximum cross-sectional width dimension and an outer periphery about which the goal pad is wrapped, said wall extending at least about 75% around the outer periphery of the post, said wall having a maximum thickness that is less than about 50% of the maximum cross-sectional width dimension of the at least one post.

15. The soccer goal assembly as claimed in claim 14, said maximum thickness of the wall being about ⅝ of an inch.

16. The soccer goal assembly as claimed in claim 14, said body being formed of a foam material, said foam material having a Bashore Resiliency Test value of at least about 35.

17. The soccer goal assembly as claimed in claim 1, said first one of the wall portions overlying the front section of the post, and said pair of wall portions each overlying a respective one of the side sections of the post.

* * * * *